US007398032B2

(12) United States Patent
Ota

(10) Patent No.: US 7,398,032 B2
(45) Date of Patent: Jul. 8, 2008

(54) IMAGE FORMING APPARATUS FEATURING FIRST AND SECOND CLEANERS OPERABLE ON THE BASIS OF AN INTERVAL OF AN IMAGE FORMING PROCESS DURING A CONTINUOUS IMAGE FORMING PROCESS

(75) Inventor: Mitsuhiro Ota, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 234 days.

(21) Appl. No.: 11/275,125

(22) Filed: Dec. 13, 2005

(65) Prior Publication Data

US 2006/0127124 A1 Jun. 15, 2006

(30) Foreign Application Priority Data

Dec. 13, 2004 (JP) ..... 2004-359594

(51) Int. Cl.
*G03G 15/00* (2006.01)

(52) U.S. Cl. ..... 399/101; 399/71

(58) Field of Classification Search ..... 399/101, 399/346, 71, 358
See application file for complete search history.

(56) References Cited

U.S. PATENT DOCUMENTS

2005/0196196 A1 9/2005 Ota et al. ..... 399/159

FOREIGN PATENT DOCUMENTS

JP 2-282776 11/1990
JP 5-297739 11/1993
JP 09197763 A * 7/1997
JP 2002-72713 3/2002
JP 2002-372902 12/2002
JP 2006195438 A * 7/2006

* cited by examiner

*Primary Examiner*—Susan S. Lee
(74) *Attorney, Agent, or Firm*—Fitzpatrick, Cella, Harper & Scinto

(57) ABSTRACT

An image forming apparatus includes an image bearing member on which an electrostatic image is formed; a development device which develops the electrostatic image formed on the image bearing member, and forms a toner image; a first transfer device which transfers the toner image on the image bearing member to an intermediate transfer member at a first transfer position; a first cleaning device for cleaning the image bearing member; a second transfer device which transfers the toner image on the intermediate transfer member to a recording material at a second transfer position; a second cleaning device for cleaning the intermediate transfer member; and a determining device which determines, whether the toner on the intermediate transfer member is to be cleaned by the second cleaning device or by the first cleaning device through the image bearing member, based an interval of an image forming process during a continuous image forming process.

5 Claims, 8 Drawing Sheets

IMAGE FORMING APPARATUS FEATURING FIRST AND SECOND CLEANERS OPERABLE ON THE BASIS OF AN INTERVAL OF AN IMAGE FORMING PROCESS DURING A CONTINUOUS IMAGE FORMING PROCESS

BACKGROUND OF THE INVENTION

1. Field of the Invention

This invention relates to an image forming apparatus for transferring a developer image to a transfer material from an image bearing member through a transfer medium.

2. Description of the Related Art

An image forming apparatus having a development means in which an electrostatic latent image formed on the surface of a photosensitive drum constituting an image bearing member is developed by the toner in a powder developer is widely put into practical use. FIG. 8 is a diagram for explaining the essential parts of the conventional image forming apparatus. The image forming apparatus shown in FIG. 8 is a full-color electrophotographic image forming apparatus having at least one (for example, four) photosensitive drum 1 as an image bearing member and an intermediate transfer belt 51 as a transfer medium. Around the photosensitive drum 1, a charger 2, an exposure unit 3, a development unit 4, a photosensitive member cleaner 6, and the like are arranged and make up a process unit P constituting an image forming means. The developer image formed on the photosensitive drum 1 is primarily transferred sequentially in a primary transfer unit N1 onto an intermediate transfer belt 51 of an intermediate transfer unit 5 and is further secondarily transferred to a transfer material S such as paper in a secondary transfer unit N2.

The deposited materials remained on the photosensitive drum 1 (mainly the toner remained after the primary transfer) such as the toner after toner image transfer are removed by the photosensitive member cleaner 6. The cleaning blade 61 of the photosensitive member cleaner 6 is pressed against the photosensitive drum 1 at a predetermined angle and a predetermined pressure, and recovers the toner and the like remaining on the surface of the photosensitive drum 1. The photosensitive drum 1 from which the remaining toner has been removed by the photosensitive cleaner 6 is returned to the charging process and the aforementioned series of the image forming operation are repeated.

The deposited materials remained on the intermediate transfer belt 51 (mainly the toner remained by the secondary transfer) such as the toner is basically removed by a belt cleaner 55. The belt cleaner 55 is arranged downstream of the secondary transfer unit N2 in the rotational direction of the intermediate transfer belt 51, and may be configured of a blade or a fur brush impressed with a predetermined voltage or the like.

Further, a configuration has been conventionally proposed in which the residue on the intermediate transfer belt 51 is recovered by the photosensitive member cleaner 6 of the photosensitive drum 1. Specifically, a voltage of opposite polarity to the toner, or the like is applied to the primary transfer roller 53 in the primary transfer unit N1 so that the toner, or the like on the intermediate transfer belt 51 is transferred to the photosensitive drum 1 (by movement in the opposite direction to the primary transfer), and the photosensitive drum 1 is cleaned by the photosensitive member cleaner 6.

Meanwhile, the cleaning blade 61 of the photosensitive member cleaner 6 cleans by rubbing the surface of the photosensitive drum 1. The toner and the additives remained on the surface of the photosensitive drum 1 after the first transfer process plays an important role in holding the lubricity between the blade and the surface of the photosensitive drum. The use of an additive which improves the lubricity such as titanium oxide or alumina fine powder, or an additive which improves the grinding performance such as strontium titanate powder, cerium oxide powder or calcium titanate powder is effective. Specifically, these additives improve the lubricity of the surface of the photosensitive drum, and prevents the components of the toner from being attached on the surface of the photosensitive drum and the image quality from being deteriorated and the smoothness of the cleaning blade from being deteriorated by increasing the friction coefficient of the surface of the photosensitive drum.

In the case where an image is formed by such image forming apparatus, on the other hand, the photosensitive drum may rotate for a long time without being supplied with the developer in the case where a conveyance path of the transfer material is long or an interval between the image forming sessions is long. As long as the photosensitive drum is rotated without being supplied with the toner, the amount of the toner and the additive having the lubrication effect between the photosensitive drum and the cleaning blade is reduced. The resulting rotation of only the photosensitive drum and the cleaning blade especially made of an elastic body increases the friction force between the photosensitive drum and the blade and deteriorates the smoothness of the cleaning blade. Once this state is maintained, the problem is caused such as the image flow due to the deterioration of the drum surface, the cut, twist, wear or noise of the blade.

To solve this problem, Japanese Patent Application Laid-open (JP-A) No. 2002-072713 discloses a method in which the developer is supplied to the drum cleaning unit between and after image forming sessions as a special control operation to supply the toner to the cleaning unit.

According to the technique proposed according to the JP-A No. 2002-072713, however, the developer is required to be supplied to and recovered from the photosensitive drum at timings other than image formation. Therefore problems such as generation of a standby time in the operation of the image forming apparatus or reduction in the productivity (number of images formed per unit time) have occurred.

SUMMARY OF THE INVENTION

The object of this invention is to provide an image forming apparatus in which the developer used to form an image is recovered efficiently by a first recovery means without deteriorating the productivity thereby to lengthen the life of the image bearing member and the first recovery means.

According to this invention, there is provided an image forming apparatus comprising:

an image bearing member on which an electrostatic image is formed;

a development means which develops the electrostatic image formed on the image bearing member using developer, and forms a developer image;

a first transfer means which transfers the developer image on the image bearing member to an intermediate transfer member by a first transfer unit;

a first recovery means which recovers the developer on the image bearing member;

a second transfer means which transfers the developer image on the intermediate transfer member at a second transfer position; and a second recovery means which recovers the developer on the intermediate transfer member; and a means which determines, at the time of continuous transfer of the developer image to the plurality of the transfer materials, whether the developer on the intermediate transfer member is to be recovered by the second recovery means or by the first recovery means through the image bearing member, based on at least the time interval of sessions of developer image transfer to the transfer materials, wherein the developer on the intermediate transfer member can be recovered by the second recovery means or by the first recovery means through the image bearing member, and the developer image can be continuously transferred to a plurality of transfer materials.

DETAILED DESCRIPTION OF THE INVENTION

According to the invention, the problem mentioned above is solved by providing a means for determining, when the developer image is transferred continuously to a plurality of the transfer materials, whether the developer on the intermediate transfer member is recovered by the second recovery means or by the first recovery means through the image bearing member, based on at least the time intervals of the sessions of the developer image transfer to the transfer materials. In other words, the developer can be supplied to the image bearing member during the normal image formation and therefore the developer can be supplied to the image bearing member without adversely affecting the normal image formation.

FIRST EMBODIMENT

An image forming apparatus according to a first embodiment of the invention is explained.

Apparatus Configuration and General Operation

Figure 6:
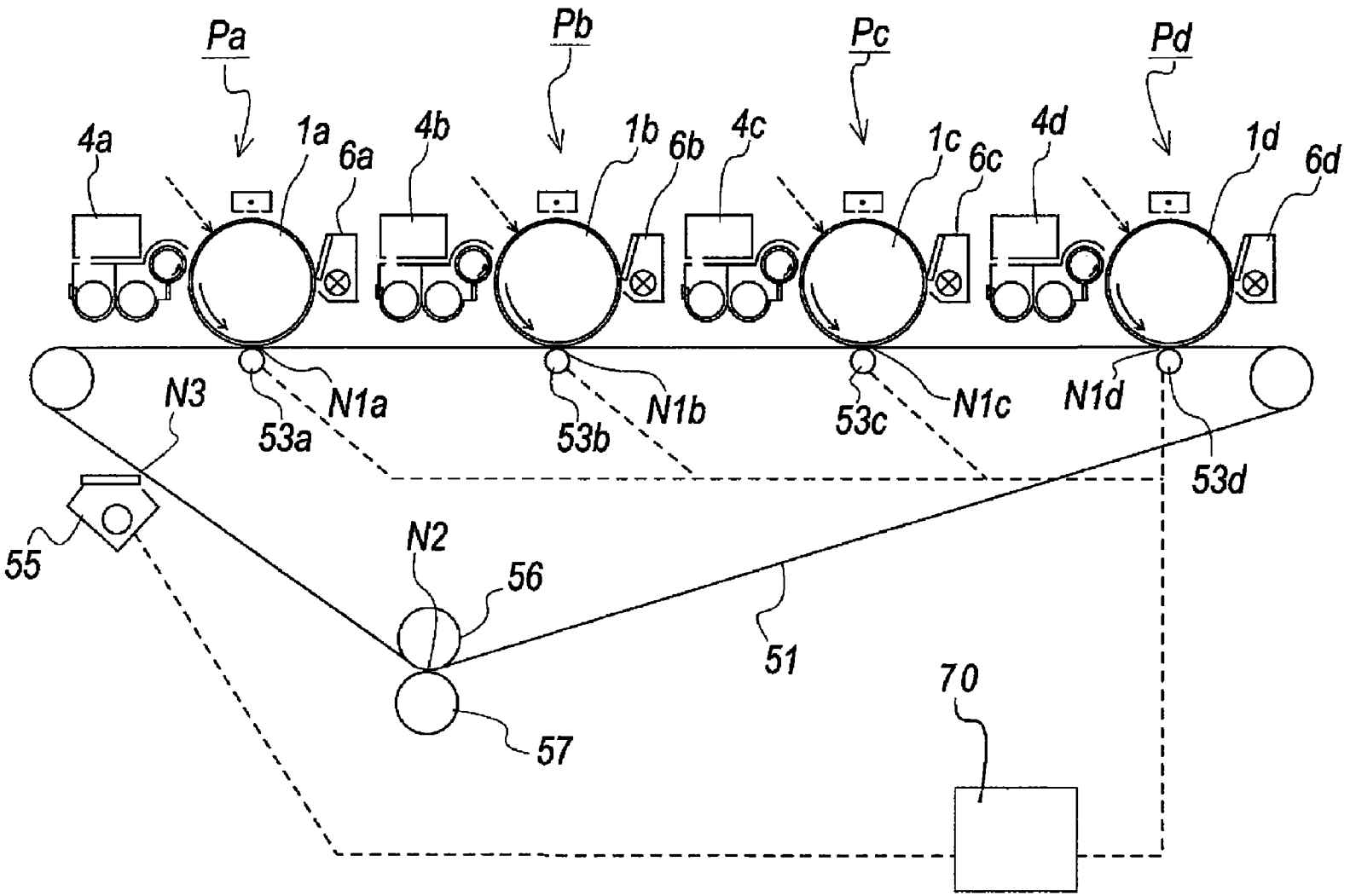
FIG. 6 is a diagram for explaining the essential parts of an image forming apparatus according to an embodiment.

First, the configuration and the general operation of the apparatus are explained with reference to FIGS. 6 and 7. FIG. 6 is a diagram for explaining the essential parts of the image forming apparatus according to this embodiment, and FIG. 7 a diagram for explaining a processing unit.

The image forming apparatus shown in FIG. 6 is a full-color electrophotographic image forming apparatus including four photosensitive drums 1*a* to 1*d* as an image bearing member and an intermediate transfer belt (intermediate transfer member) 51 as a transfer medium. Around the photosensitive drums 1*a* to 1*d*, there are arranged chargers 2*a* to 2*d*, exposure units 3*a* to 3*d*, development units 4*a* to 4*d*, photosensitive member cleaners 6*a* to 6*d*, and the like, each of which make up a processing unit Pa to Pd constituting an image forming means. Images (developer images) of yellow, magenta, cyan and black formed on the photosensitive drum 1 in each processing unit are sequentially primary transferred in a primary transfer unit N1 onto an intermediate transfer belt 51 moving while in contact with the photosensitive drum 1. The images transferred onto the intermediate transfer belt 51 are further secondary transferred onto transfer materials such as paper in a secondary transfer unit N2.

The processing units have the same configuration, and therefore each element of the processing unit Pa is explained as an example without the suffixes a to d. A photosensitive drum 1 as an example of image bearing members is arranged on the processing unit P making up an image forming means. The photosensitive drum 1 is rotatable in the direction of arrow. Further, around the photosensitive drum 1, there are arranged a charger 2 making up a primary charging means, an exposure unit 3, a development unit 4 and a photosensitive member cleaner (first recovery means) 6 in that order along the direction of rotation of the photosensitive drum 1. Each processing means acting on the photosensitive drum 1 for image formation is controlled by a control means (not shown).

Figure 7:
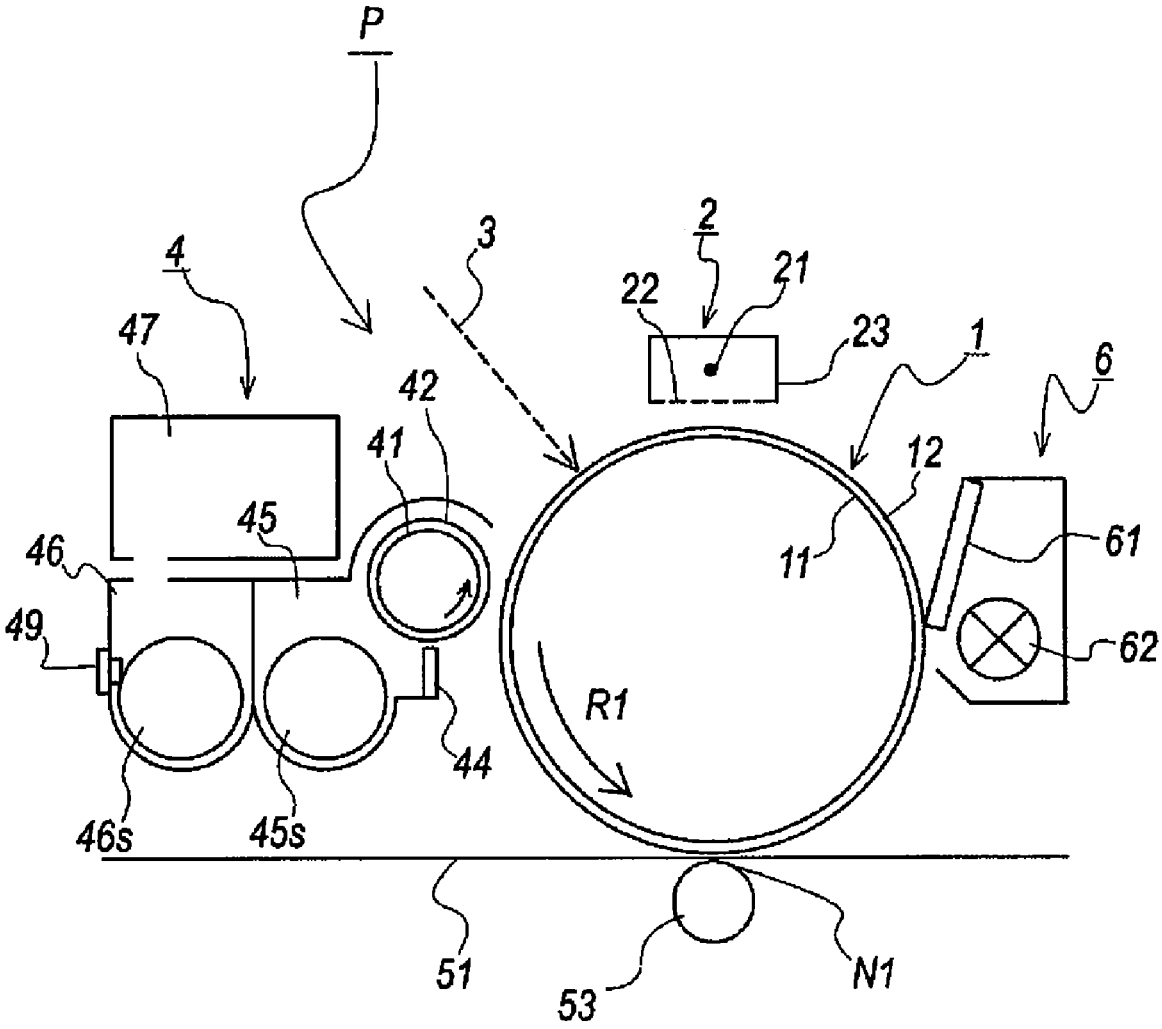
FIG. 7 is a diagram for explaining a processing unit.
Figure 8:
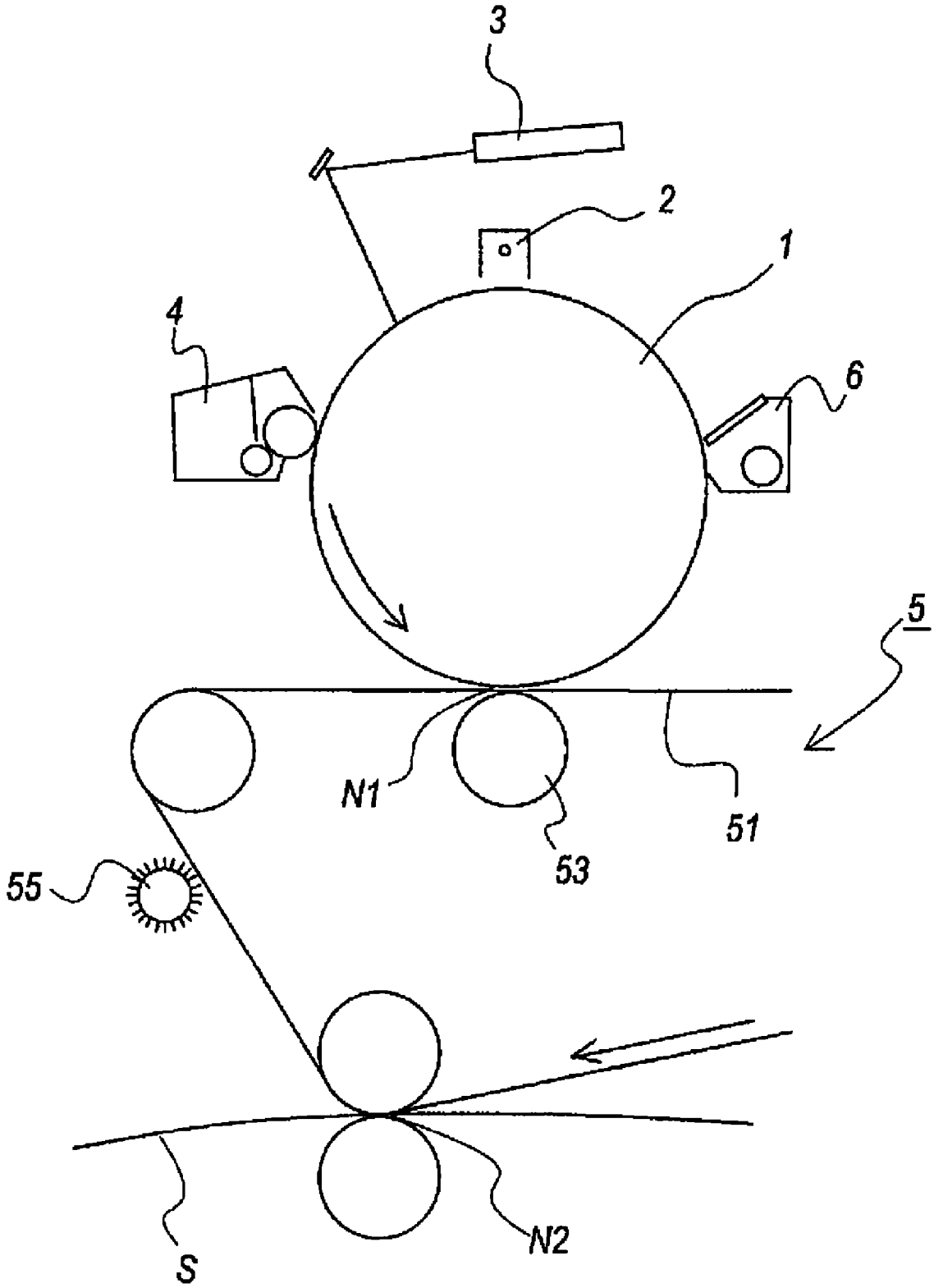
FIG. 8 is a diagram for explaining the essential parts of the conventional image forming apparatus.

As shown in FIG. 7, each photosensitive drum 1 is a cylindrical electrophotographic photosensitive drum basically configured of a conductive base 11 such as aluminum and a photoconductive layer 12 formed on the outer periphery of the base 11. The photosensitive drum 1 has a fulcrum shaft at the center thereof and is adapted to be rotated around the fulcrum shaft thereof at the processing rate (Ps) of 300 mm/s in the direction of arrow R1.

The charger 2 is arranged above each photosensitive drum 1. The charger 2 is configured of a wire 21, a grid 22 and a shield member 23, and arranged at the distance of 5 mm from the surface of the photosensitive drum 1 to charge the surface uniformly to a predetermined polarity and potential. Specifically, a constant current of 1 mA is supplied to the wire 21 and a constant voltage of −720 V is applied to the grid 22 from a power supply (not shown) thereby to charge the surface of the photosensitive drum 1 uniformly to −700 V. The exposure unit 3 is arranged downstream of the charger 2 in the direction of rotation of the photosensitive drum 1. The exposure unit 3 scans while turning on/off the laser light in accordance with the image data (image information), so that the surface potential of the photosensitive drum 1 thus irradiated reaches −150 V thereby to form an electrostatic latent image (electrostatic image).

The development unit (developing means) 4 arranged downstream of each exposure unit 3 includes a developer container 41 for containing a developer formed of two components including a toner (developer) and a carrier (magnetic member). A development sleeve 42 is rotatably arranged in the opening of the developer container 41 facing the photosensitive drum 1, and a magnet roller 43 for carrying the toner on the development sleeve 42 is fixedly arranged in the development sleeve 42. Above the development sleeve 42 of the developer container 41, a control blade 44 for controlling the developer carried on the development sleeve 42 and forming a thin developer layer is arranged. Further, a development chamber 45 and an agitation chamber 46 which are defined are provided in the developer container 41 and contain screws 45*s*, 46*s*, respectively, to agitate and convey the developer. A supply chamber 47 containing the supply toner is arranged above the developer container 41. A developer concentration detection means 49 is a sensor for detecting the permeability and arranged upstream of the agitation chamber 46 and the opening through which the toner is supplied in the direction in which the developer is conveyed.

The toner formed into a thin developer layer is conveyed to the developing area opposed to the photosensitive drum 1 and the napping thereof is formed by the magnetic force of the main developing pole located in the developing area of the magnet roller 43 thereby to form a magnetic brush. The surface of each photosensitive drum 1 is rubbed with the magnetic brush while at the same time applying to the development sleeve 42 a DC voltage of −500 V and an AC voltage Vp-p of 1800 V with a frequency of 120000 Hz superposed one another from a power supply (not shown). As a result, the toner attached to the carrier forming the napping of the magnetic brush is attached to and develops the exposed portion of the electrostatic latent image thereby to form a toner image on each photosensitive drum 1. In this way, the toner in the developer is consumed by the development process. Once the toner is consumed, however, the toner in the same amount as the consumed toner is newly supplied from the supply chamber 47 in accordance with the toner concentration change detected by the developer concentration detection means 49. In this way, a constant image concentration is maintained.

A primary transfer roller 53 is arranged under each photosensitive drum 1 downstream of the development unit 4. The primary transfer roller 53 is pressed in contact with the surface of the photosensitive drum 1 through the intermediate transfer belt 51 under the pressure of 9.8 mN, and a primary transfer unit N1 is formed between the photosensitive drum 1 and the primary transfer roller 53. The intermediate transfer belt 51 is held by a transfer nip, and by applying the DC voltage of +1000 V from a power supply (not shown) to the primary transfer roller 53, the toner charged to a negative voltage is transferred to the surface of the intermediate transfer belt 51 from the surface of the photosensitive drum 1.

After toner image transfer, the materials such as the remaining toner deposited on the photosensitive drum 1 are removed by the photosensitive member cleaner 6. The photosensitive member cleaner 6 includes a cleaning blade (blade member) 61 and a conveyance screw 62. The photosensitive drum from which the remaining toner has been removed by the photosensitive member cleaner 6 returns to the charging process to repeat the series of the image formation described above.

As shown in FIG. 6, the intermediate transfer unit 5 is arranged under each photosensitive drum 1. The intermediate transfer unit 5 includes an intermediate transfer belt 51, primary transfer rollers (first transfer means) 53*a* to 53*d*, a secondary transfer opposite roller 56, a secondary transfer roller (second transfer means) 57 and a belt cleaner (second recovery means) 55. The belt cleaner 55, though adapted to be configured of a fur brush or the like impressed with a predetermined voltage, is formed of an elastic blade according to this embodiment.

The toner image of each color formed on the photosensitive drum 1, after being transferred sequentially onto the intermediate transfer belt 51 in the primary transfer unit N1 as described above, is conveyed to the secondary transfer unit N2 with the rotation of the intermediate transfer belt 51. By this time, the transfer material S is fed from a sheet cassette (not shown) and a toner image is transferred onto the transfer material S by the secondary transfer bias applied between the secondary transfer opposite roller 56 and the secondary transfer roller 57. The remaining toner or the like on the intermediate transfer belt 51 is removed and recovered by the belt cleaner 55. The transfer material S to which the transfer image has been transferred is pressed and heated by a fixing means not shown, so that the toner image is melted and fixed thereby to form a full color image on the transfer material S.

The toner used in this embodiment is formed of color toner particles which is made of polyester resin and has the average particle size of 6 μm to which strontium titanate powder having the average longitudinal particle size of 1 μm and hydrophobic alumina fine powder having the average longitudinal particle size of 0.1 μm are added. Also, a ferrite carrier having the average particle size of 50 μm is used as a carrier. The toner is charged negatively to −25 μC/mg by the friction contact with the carrier.

Characteristic Operation

Figure 1:
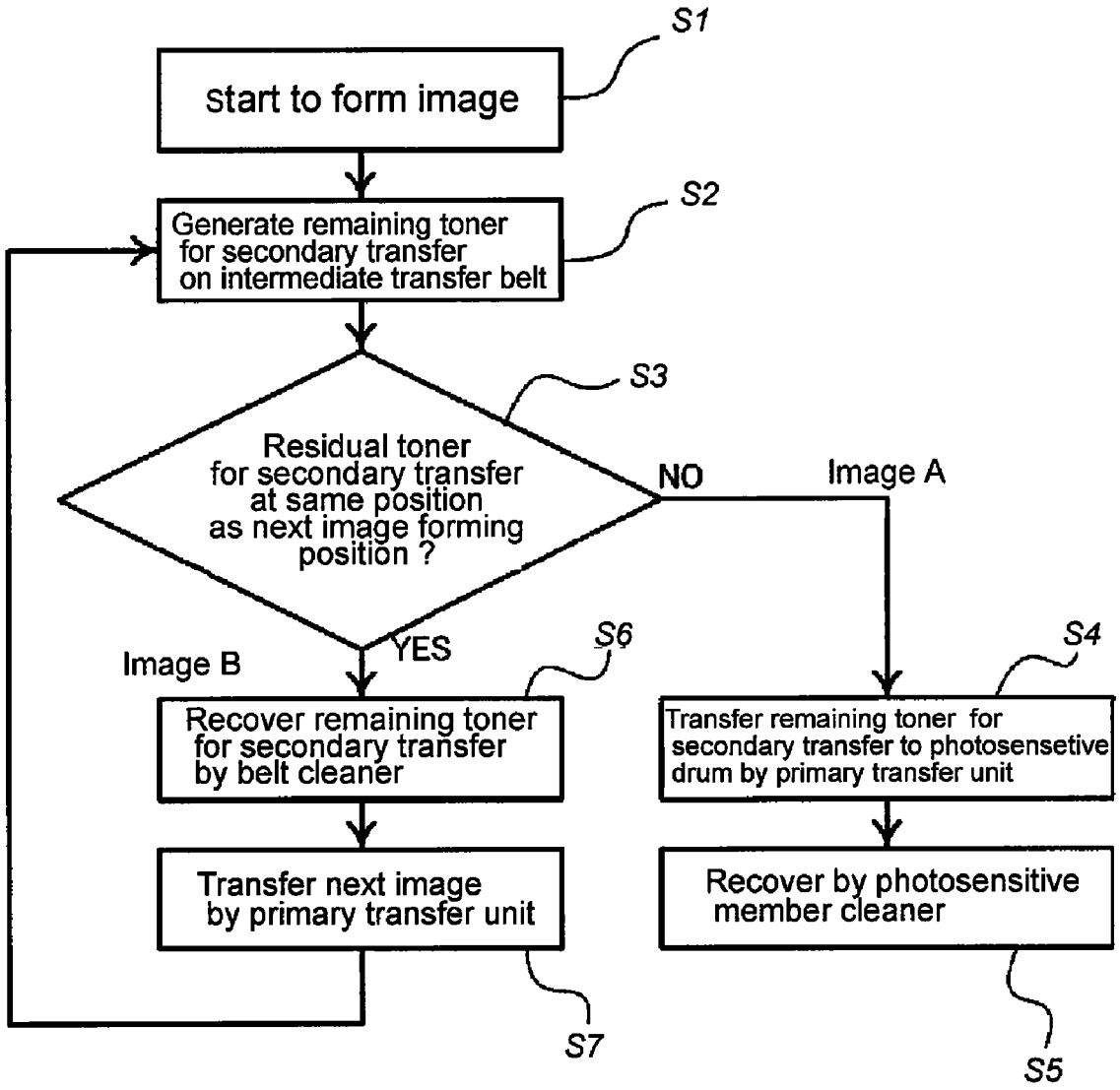
FIG. 1 is a flowchart for controlling the select operation.

Next, the characteristic operation of this embodiment, i.e. the select operation to determine whether the developer on the intermediate transfer belt 51 is to be recovered by the second recovery means or by the first recovery means through the image bearing member is performed in accordance with the timing of the image formation. This select operation is performed by a determining means 70 shown in FIGS. 6 and 2. FIG. 1 is a flowchart for controlling the select operation, FIG. 2 a diagram for explaining the flow of the remaining toner, FIG. 3 a timing chart for explaining the movement of the toner image on the primary transfer unit, the secondary transfer unit and the belt cleaning unit, and FIG. 4 a diagram showing the torque change between the photosensitive drum and the cleaning blade.

Figure 2:
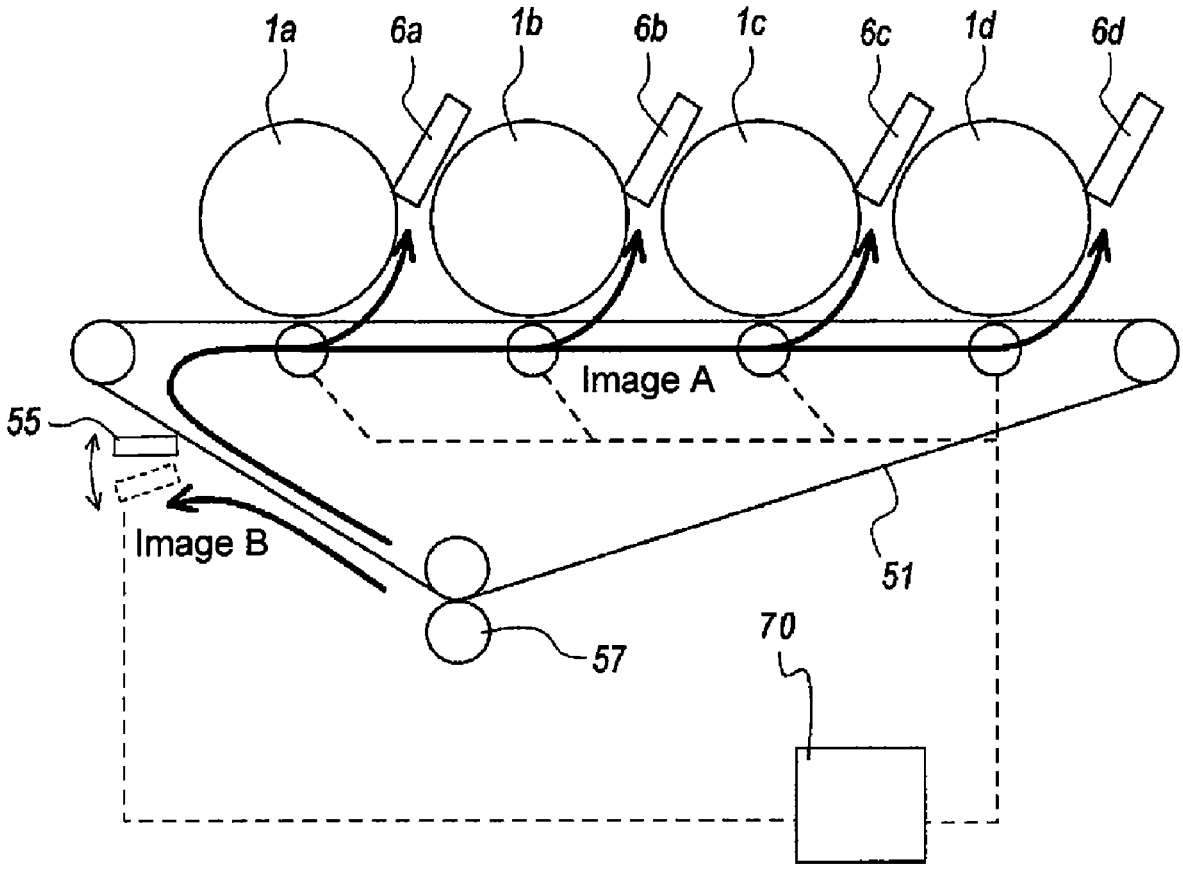
FIG. 2 is a diagram for explaining the flow of the remaining toner after the transfer operation.

According to this embodiment, the belt cleaner 55 is adapted to be brought into or out of contact with the intermediate transfer belt 51. As shown in FIG. 2, once the belt cleaner 55 is brought into contact with the intermediate transfer belt 51, the remaining toner on the intermediate transfer belt 51 is recovered by the belt cleaner 55. The contact position between the belt cleaner 55 and the intermediate transfer belt 51 is assumed to form a belt cleaning unit N3.

As indicated by dashed line in FIG. 2, the remaining toner is conveyed to the primary transfer unit N1 by separating the intermediate transfer belt 51 from the belt cleaner 55. In the process, the primary transfer roller 53 is impressed with the DC voltage of −1000 V, for example, from a power supply (not shown). In this way, the remaining toner mainly charged positive can be transferred to the surface of the photosensitive drum 1 from the surface of the intermediate transfer belt 51. In accordance with the charge polarity of the toner used, a positive or negative bias is applied to the primary transfer roller 53. Also, depending on the characteristics of the toner, different transfer biases can be applied at the time of normal image forming process and the recovery time. The remaining toner transferred to the photosensitive drum 1 is recovered by the photosensitive member cleaner 6, so that the developer can be supplied between the photosensitive drum 1 and the cleaning blade 61 of the photosensitive member cleaner 6.

The intermediate transfer belt 51 circulates (rotates), and therefore an image may or may not be formed at the same position as the previous image. Specifically, the remaining toner is attached at the previous image forming position on the intermediate transfer belt 51 passed through the secondary transfer unit N2, and the problem is whether a new developer is transferred or not when the particular position passes through the primary transfer unit N1. This is by reason of the fact that the toner image cannot be transferred from the photosensitive drum 1 to the intermediate transfer belt 51 at the same time as the toner is transferred (recovered) from the intermediate transfer belt 51 to the photosensitive drum 1.

Figure 3:
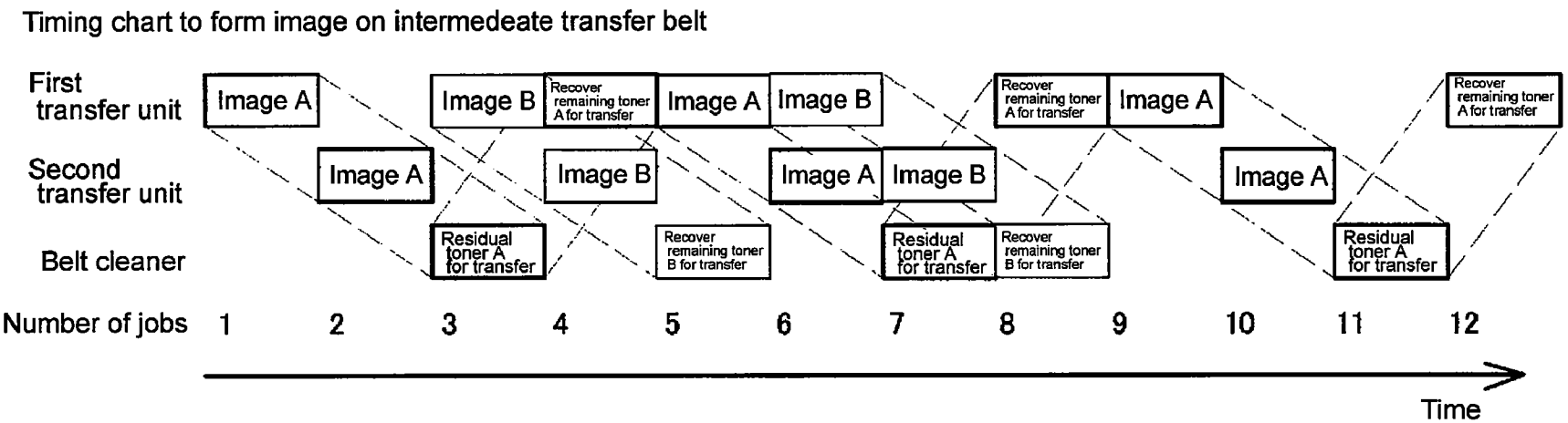
FIG. 3 is a timing chart for explaining the movement of the toner image in the primary transfer unit, the secondary transfer unit and the belt cleaning unit according to a first embodiment.

FIG. 3 shows the manner in which the toner image on the intermediate transfer belt 51 is continuously transferred to a plurality of transfer materials.

The image A shown in FIG. 3 is such that the position at which the previous image is formed is not in superposed relation with the position at which the next image is formed in the primary transfer unit N1. This occurs in the case where the throughput is low with a wide interval at which the image is formed, for example, in the case where the image is formed on one or two sides, or where the job interval is long and the rotation time of the photosensitive drum is long. In FIG. 3, the time axis is not plotted in proportion to actual time and shown as a model to facilitate the understanding.

Once the image begins to be formed (S1 in FIG. 1), the image A transferred to the intermediate transfer belt 51 by the primary transfer unit N1 is conveyed to the secondary transfer unit N2 by the intermediate transfer belt 51 and transferred to the transfer material S. At the same time, the remaining toner is generated (S2 in FIG. 1). This toner is called the remaining toner A.

Step S in FIG. 1 determines whether the position where the remaining toner is located constitutes the next image forming position or not. The determination at step S3 is NO for the image A, and therefore the belt cleaner 55 is separated from the intermediate transfer belt 51 and no remaining toner A is recovered. The remaining toner A on the intermediate transfer belt 51 reaching the primary transfer unit N1 is transferred to the photosensitive drum 1 (S4 in FIG. 1) and recovered by the photosensitive member cleaner 6 (S5 in FIG. 1). In this way, the remaining toner for secondary transfer can be supplied between the photosensitive drum 1 and the cleaning blade 61.

The image B shown in FIG. 3 is such that the position at which the previous image is formed is the same as the position at which the next image is formed in the primary transfer unit N1. The image formation is started (S1 in FIG. 1), and the image B is transferred to the transfer material S through the primary transfer unit N1 and the secondary transfer unit N2. Then, the remaining toner B is generated (S2 in FIG. 1). Step S3 in FIG. 1 determines whether the position of the remaining toner is coincident with the position at which the next image is formed. The determination is YES for the image B. The belt cleaner 55 is brought into contact with the intermediate transfer belt 51 and the remaining toner B is recovered by the belt cleaning unit N3 (S6 in FIG. 1). In the primary transfer unit N1, the next image is primarily transferred to the particular position (S7 in FIG. 1).

Figure 4:
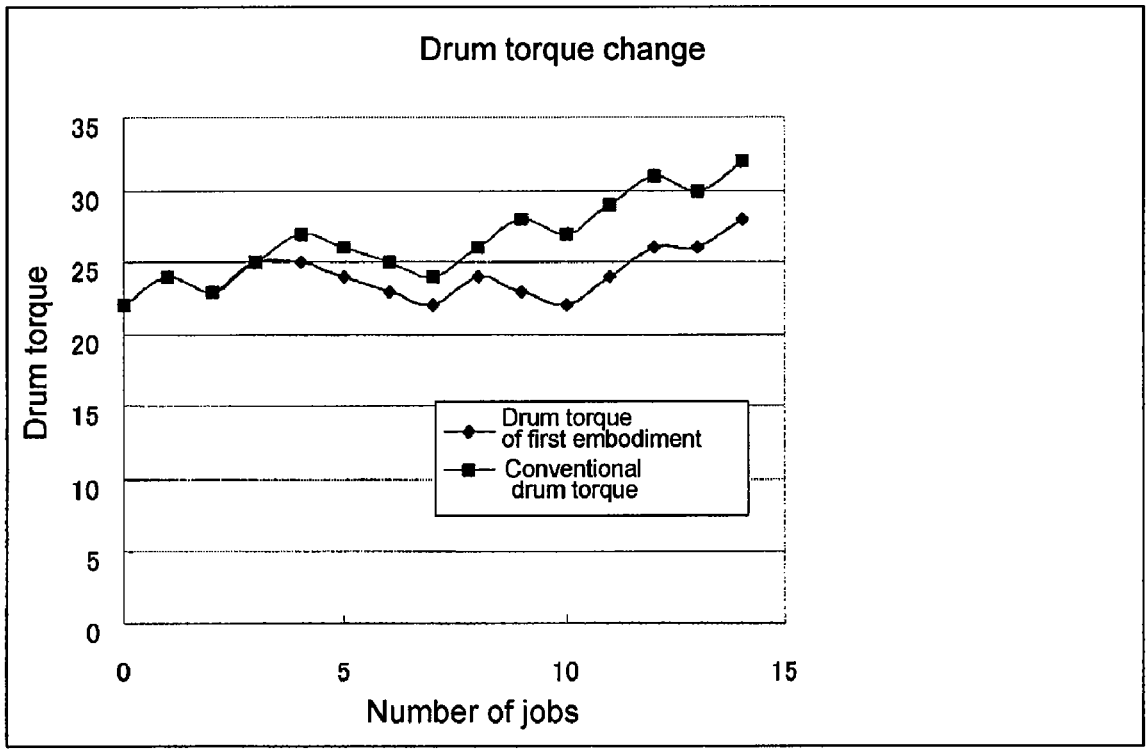
FIG. 4 is a diagram for explaining the torque change between the photosensitive drum and the cleaning plate.

FIG. 4 is a diagram showing the torque change between the photosensitive drum 1 and the cleaning blade 61. As understood from FIG. 4, once the remaining toner for secondary transfer is recovered by the photosensitive member cleaner 6, the torque increases more gradually. Specifically, the torque between the photosensitive drum 1 and the cleaning blade 61 is suppressed, and therefore the load thereon is reduced, thereby improving the durability thereof.

The method according to this embodiment contributes to the effective utilization of the toner already used to form an image. Unlike in the conventional configuration described above, the toner not required for the real image forming process is not used, and therefore the wasteful toner consumption is suppressed.

The determination means 70 is preferably incorporated specifically as a part of the controller of the image forming apparatus, and implemented by an arithmetic means such as a CPU or a MPU and a control program stored in the ROM or the like. The determination means 70 is connected to the primary transfer roller 53 and the belt cleaner 55 indirectly through a drive control or the like or directly to a sensor included in the primary transfer roller 53 and the belt cleaner 55 to execute the select operation according to this embodiment.

SECOND EMBODIMENT

An image forming apparatus according to a second embodiment of the invention is explained. This embodiment is so configured that the belt cleaner 55 recovers the remaining toner electrostatically using a brush in place of the elastic blade separable from the belt.

With the cleaner having the brush, the remaining toner can be recovered by applying a bias of the opposite polarity to the remaining toner. By applying a bias of the same polarity as the remaining toner, on the other hand, the remaining toner can be prevented from being recovered by the brush. Then, the remaining toner can be conveyed as it is to the primary transfer unit N1 through the belt cleaner 55. In the primary transfer unit N1, a bias is applied with such a polarity as to transfer the remaining toner to the photosensitive drum 1. The determination means 70 determines whether the toner on the intermediate transfer belt 51 is to be recovered by the belt cleaner 55 or the photosensitive drum 1.

Specifically, in the case where the elastic blade is used as the belt cleaner 55, a separation mechanism is required to determine whether the cleaning is to be conducted or not. With the configuration according to this embodiment in which the mechanical operation of separating the belt cleaner 55 is not performed, in contrast, the effect of vibrations having on the image forming unit is reduced.

THIRD EMBODIMENT

Figure 5:
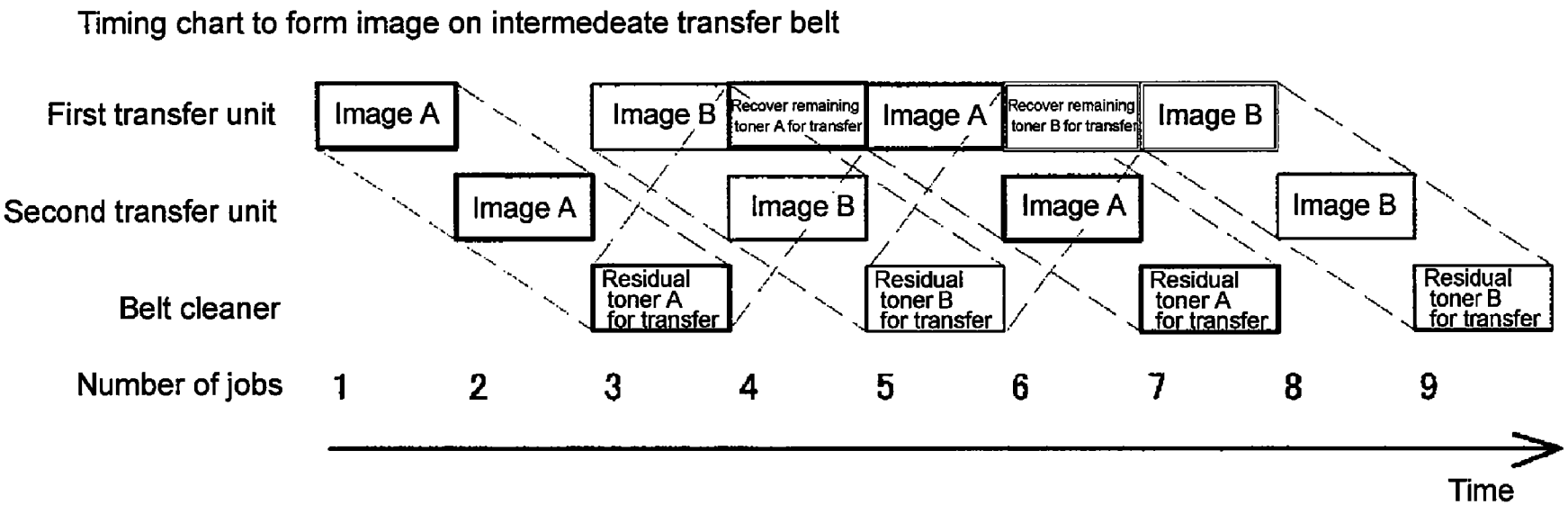
FIG. 5 is a timing chart for explaining the movement of the toner image in the primary transfer unit, the secondary transfer unit and the belt cleaning unit according to a third embodiment.

An image forming apparatus according to a third embodiment of the invention is explained. FIG. 5 is a timing chart for explaining the movement of the toner image in the primary transfer unit, the secondary transfer unit and the belt cleaning unit 3 according to this embodiment. This timing chart is explained by designating the same component parts as those in the first embodiment by the same reference numerals, respectively.

In the first embodiment described above, the select operation is performed to determine whether the developer on the transfer medium is to be recovered by the second recovery means or the first recovery means through the image bearing member in accordance with the image formation timing. According to this embodiment, in contrast, the remaining toner remaining on the intermediate transfer belt 51 after the transfer operation is basically recovered by the photosensitive member cleaner 6, while the timing of the next image forming session is changed.

In the timing chart of FIG. 5, the image A is such that the previous image forming position is not coincident with the next image forming position in the primary transfer unit N1, and the image B is such that the two positions are coincident with each other. In the case where the remaining toner B reaches the primary transfer unit N1, as indicated by a double frame in the drawing, the next image forming session is carried out only after the transfer of the remaining toner B is transferred to the photosensitive drum 1.

This configuration makes it possible to supply the toner more frequently between the photosensitive drum 1 and the cleaning blade 61, and therefore the torque change of the photosensitive drum 1 can be reduced.

Normally, the productivity is maintained by the control operation shown in the first embodiment, and the configuration of the third embodiment including the control operation may be employed upon determination that the toner is required to be supplied in accordance with the torque change. As a result, the balance between the productivity and the torque reduction can be maintained.

CROSS -REFERENCE TO RELATED APPLICATION

This application claims the benefit of priority from the prior Japanese Patent Application No. 2004-359594 filed on Dec. 13, 2004 the entire contents of which are incorporated by reference herein.

What is claimed is:

1. An image forming apparatus comprising:

an image bearing member on which an electrostatic image is formed;

a development means which develops the electrostatic image formed on the image bearing member, and forms a toner image;

a first transfer means which transfers the toner image on the image bearing member to an intermediate transfer member at a first transfer position;

a first cleaning means which cleans toner from the image bearing member;

a second transfer means which transfers the toner image on the intermediate transfer member to a recording material at a second transfer position;

a second cleaning means which cleans toner from the intermediate transfer member; and a determining means which determines whether the toner on the intermediate transfer member is to be cleaned by the second cleaning means or by the first cleaning means through the image bearing member, based on an interval of an image forming process during a continuous image forming process.

2. The image forming apparatus according to claim 1, wherein the determining means selects the first cleaning means when the interval of the image forming process is longer than a length of the toner image to be cleaned on the intermediate transfer member and a new toner image on the image bearing member is not transferred on a region of the intermediate transfer member on which toner remains after transfer.

3. The image forming apparatus according to claim 1, wherein the determining means selects the second cleaning means when a new toner image on the image bearing member is transferred on a region of the intermediate transfer member on which toner remains after transfer.

4. The image forming apparatus according to claim 1, wherein the second cleaning means is capable of contacting with and separating from the intermediate transfer member and the second cleaning means separates from the intermediate transfer member when toner remaining after transfer is cleaned by the first cleaning means.

5. The image forming apparatus according to claim 1, wherein the second cleaning means includes a brush member to contact with the intermediate transfer member and the brush member cleans toner remaining after transfer by applying a biasing voltage thereon.

* * * * *

UNITED STATES PATENT AND TRADEMARK OFFICE

CERTIFICATE OF CORRECTION

PATENT NO. : 7,398,032 B2
APPLICATION NO. : 11/275125
DATED : July 8, 2008
INVENTOR(S) : Mitsuhiro Ota It is certified that error appears in the above-identified patent and that said Letters Patent is hereby corrected as shown below:

TITLE PAGE, AT ITEM [56], References Cited, FOREIGN PATENT DOCUMENTS

"09197763 A *" should read --9-197763 A *--.

TITLE PAGE, AT ITEM [57], ABSTRACT

Line 15, "based" should read --based on--.

DRAWING SHEETS

Sheet 1 of 8, Figure 1, Step S4, "photosensetive" should read --photosensitive--.
Sheet 3 of 8, Figure 3, "intermedeate" should read --intermediate--.
Sheet 5 of 8, Figure 5, "intermedeate" should read --intermediate--.

COLUMN 1

Line 34, "remained" should read --remaining--.
Line 35, "remained" should read --remaining--.
Line 46, "remained" should read --remaining--.
Line 47, "remained" should read --remaining--.
Line 67, "remained" should read --remaining--.

COLUMN 2

Line 2, "plays" should read --play--.
Line 9, "prevents" should read --prevent--.

COLUMN 5

Line 12, "superposed" should read --superposed on--.

COLUMN 6

Line 4, "is" should read --are--; and "has" should read --have--.

COLUMN 7

Line 18, "Step S" should read --Step S3--.
Line 20, "The" should read --If the--.
Line 21, "and therefore" should be deleted.
Line 38, "The" should read --If the--; and "B. The" should read --B, the--.

UNITED STATES PATENT AND TRADEMARK OFFICE

CERTIFICATE OF CORRECTION

PATENT NO. : 7,398,032 B2
APPLICATION NO. : 11/275125
DATED : July 8, 2008
INVENTOR(S) : Mitsuhiro Ota It is certified that error appears in the above-identified patent and that said Letters Patent is hereby corrected as shown below:

COLUMN 9

Line 6, "2004 the" should read --2004, the--.

Signed and Sealed this

Twenty-seventh Day of January, 2009

JOHN DOLL
*Acting Director of the United States Patent and Trademark Office*